US005218158A

United States Patent [19]

Kimura

[11] Patent Number: 5,218,158

[45] Date of Patent: Jun. 8, 1993

[54] MUSICAL TONE GENERATING APPARATUS EMPLOYING CONTROL OF MUSICAL PARAMETERS IN RESPONSE TO NOTE DURATION

[75] Inventor: Hidemichi Kimura, Hamamatsu, Japan

[73] Assignee: Yamaha Corporation, Hamamatsu, Japan

[21] Appl. No.: 464,411

[22] Filed: Jan. 12, 1990

[30] Foreign Application Priority Data

Jan. 13, 1989 [JP] Japan ..... 1-6793

[51] Int. Cl.[5] ..... G10H 5/00; G10H 1/02

[52] U.S. Cl. ..... 84/663; 84/653

[58] Field of Search ..... 84/627, 647, 651-653, 84/662-665, 667, 626, 658, 687

[56] References Cited

U.S. PATENT DOCUMENTS

| | | | |
|---|---|---|---|
| Re. 30,906 | 4/1982 | Hiyoshi et al. . | |
| 4,292,873 | 10/1981 | Okamura et al. | 84/615 |
| 4,308,779 | 1/1982 | Suzuki et al. . | |
| 4,421,003 | 12/1983 | Kondo | 84/627 |
| 4,426,904 | 1/1984 | Ishibashi | 84/627 |
| 4,440,056 | 4/1984 | Kozuki et al. | 84/627 |
| 4,454,796 | 6/1984 | Inoue et al. | 84/652 |
| 4,662,261 | 5/1987 | Akutsu | 84/647 |
| 4,893,539 | 1/1990 | Nishimoto | 84/663 |
| 4,972,754 | 11/1990 | Choi | 84/627 |

*Primary Examiner*—William M. Shoop, Jr.
*Assistant Examiner*—Jeffrey W. Donels
*Attorney, Agent, or Firm*—Graham & James

[57] ABSTRACT

A musical tone generating apparatus generates a musical tone based on performance information generated by performing a keyboard and the like. The performance information functions to designate a first start timing of generating a musical tone signal and a second start timing of releasing a musical tone signal. Then, a period between first and second start timings is measured based on the performance information. Thus, one or more musical parameters of the musical tone is controlled in response to the measured period. Preferably, the musical parameter is the pitch, tone color, tone volume or musical effects such as portamento.

26 Claims, 6 Drawing Sheets

MUSICAL TONE GENERATING APPARATUS EMPLOYING CONTROL OF MUSICAL PARAMETERS IN RESPONSE TO NOTE DURATION

BACKGROUND OF THE INVENTION

1. Field of the Invention

The present invention relates to a musical tone generating apparatus capable of controlling musical parameters of a musical tone signal in response to performance information generated by performing a keyboard and the like.

2. Prior Art

Conventionally, the musical tone generating apparatus provides performance information generating means such as the keyboard, and musical tone signal generating means. Based on the performance information generated from the performance information generating means, the musical tone signal generating means generates the musical tone signal. Herein, by varying the musical parameters of the musical tone signal in response to the performance information, the desirable variation can be given to the musical tone signal in response to the performer's will so that the performance expression can be full of variety. For example, Japanese Patent Publication No. 63-34473 discloses the known electronic musical instrument which provides a change-over switch consisting of first and second fixed contacts and movable contact. This movable contact moves between first and second fixed contacts in connection with the key-operation. In the key-depression event, an initial-touch is detected by measuring time while the movable contact moves from first fixed contact to second fixed contact. In the key-release event, a release-touch is detected by measuring time while the movable contact returns from second fixed contact to first fixed contact. In response to the above-mentioned detection results, a tone-volume envelope and musical parameters such as the portamento to be applied to the musical tone signal are controlled.

As described above, the prior art offers several kinds of methods of controlling several musical parameters by use of the performance information (e.g., initial-touch, release-touch etc.) to thereby improve the performance expression of the musical tone generating apparatus. However, in order to further improve the performance expression of the musical tone generating apparatus, it is demanded that the musical parameters of the musical tone signal are controlled by the brand-new method other than the above-mentioned conventional methods.

SUMMARY OF THE INVENTION

It is accordingly a primary object of the present invention to provide a musical tone generating apparatus capable of further improving the performance expression by the brand-new method of controlling the musical parameters by use of the performance information.

In a first aspect of the present invention, there is provided a musical tone generating apparatus comprising:

(a) performance information generating means for generating performance information in order to designate a first start timing of starting to generate a musical tone signal and a second start timing of starting to release the musical tone signal;

(b) musical tone signal generating means for generating the musical tone signal in response to the performance information;

(c) measuring means for measuring a period between the first and second start timings based on the performance information; and (d) control mean for controlling one or more musical parameters of the musical tone signal in response to the period measured by the measuring means, whereby a musical tone signal having the one or more musical parameters which are controlled by the control means is to be generated by the musical tone signal generating means.

In a second aspect of the present invention, there is provided a musical tone generating apparatus comprising:

(a) performance information generating means for generating performance information in order to designate a first start timing of starting to generate a first musical tone signal and a second start timing of starting to release the first musical tone signal;

(b) musical tone signal generating means for generating the first musical tone signal and a second musical tone signal in response to the performance information;

(c) measuring means for measuring a period between the first and second start timings based on the performance information; and (d) control means for controlling one or more musical parameters of the second musical tone signal in response to the period measured by the measuring means, whereby the second musical tone signal is generated in accordance with the one or more musical parameters.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings.

DESCRIPTION OF A PREFERRED EMBODIMENT

Figure 1:
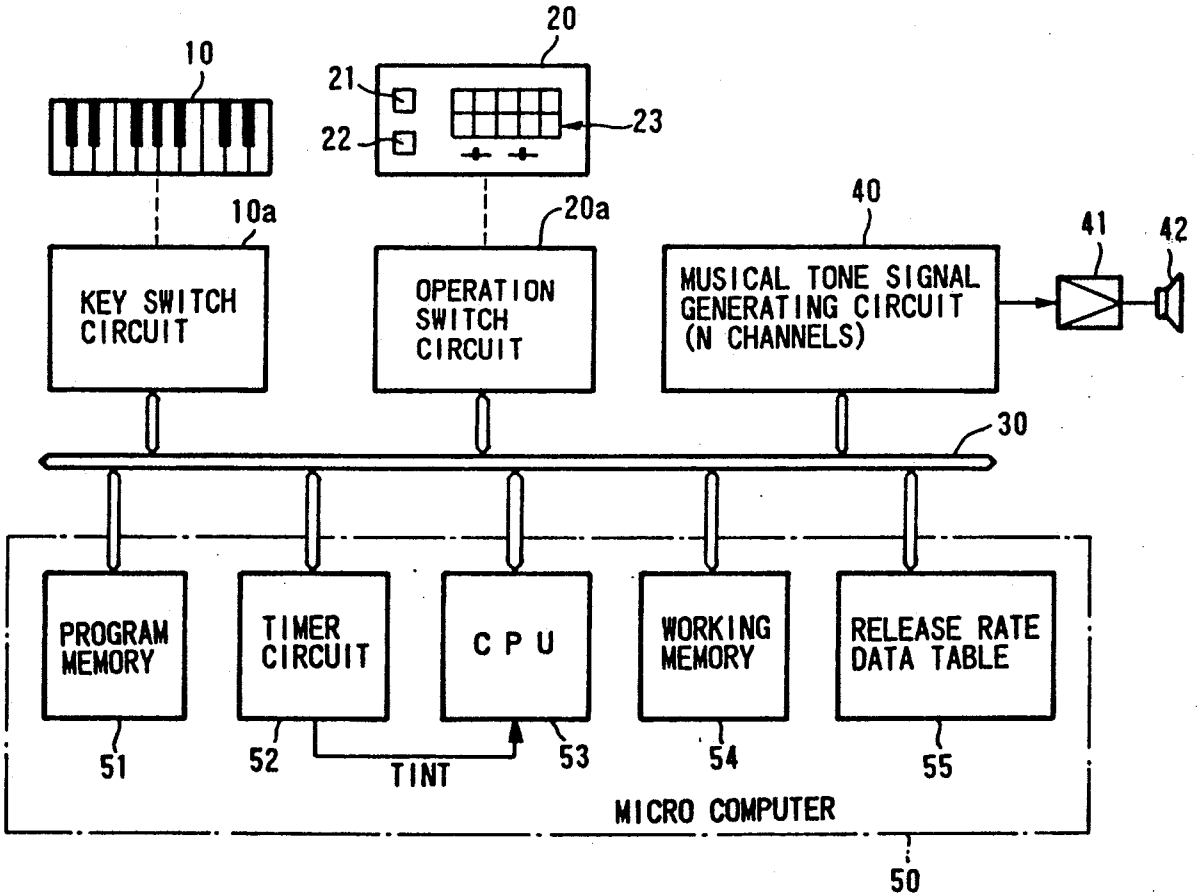
FIG. 1 is a block diagram showing the whole configuration of the electronic musical instrument according to an embodiment of the present invention.

Next, description will be given with respect to a preferred embodiment of the present invention by referring to the drawings.

CONFIGURATION OF AN EMBODIMENT

FIG. 1 is a block diagram showing the whole configuration of the electronic musical instrument according to an embodiment of the present invention.

This electronic musical instrument provides a keyboard 10 and an operation panel 20 as the foregoing performance information generating means. The keyboard 10 provides plural keys. Herein, the key-operation of each key is detected by on/off state of corresponding one of plural key switches (not shown) contained within a key switch circuit 10*a*. The operation panel 20 provides an UP switch 21, a DOWN switch 22 and other controls 23 for controlling the tone volume, selecting and changing over the musical effect etc. The operations of these switches and controls of the operation panel 20 are detected by on/off states of corresponding operation switches (not shown) contained within an operation switch circuit 20*a*.

The key switch circuit 10*a* and operation switch circuit 20*a* are both connected to a bus 30, to which a musical tone signal generating circuit 40 and a micro computer 50 are further connected. The musical tone signal generating circuit 40 provides N (where N denotes an integral number ranging from "1" to "10" or more) musical tone signal forming channels. In response to a key-on signal KON and a key-off signal KOF supplied from the micro computer 50 to the musical tone signal generating circuit 40 via the bus 30, each channel starts to generate and release the musical tone signal. In addition, the pitch, tone color, tone volume envelope, total tone volume, musical effects etc. of the musical tone signal are controlled in response to a key code KC, tone color data TC, release rate data RD, tone volume data, musical effect data etc. Then, each channel forms and outputs such musical tone signal whose musical parameters are controlled as described above. This musical ton signal generating circuit 40 is coupled to a speaker 42 via an amplifier 41.

The micro computer 50 contains a program memory 51, a timer circuit 52, a central processing unit (CPU) 53, a working memory 54 and a release rate data table 55, all of which are connected to the bus 30. The program memory 51 is constructed by a read-only memory (ROM) which stores a main program shown in FIG. 2, a timer interrupt program shown in FIG. 3 and subprograms of main program as shown in FIGS. 4–7. The timer circuit 52 is constructed by a time measuring circuit, which supplies a timer interrupt signal TINT to the CPU 53 by every predetermined time. The CPU 53 starts to execute the main program in response to turn-on of a power switch (not shown). Then, until the power switch is turned off, execution of the main program is repeated. Every time the timer circuit 52 supplies the timer interrupt signal TINT to the CPU 53, the CPU 53 breaks execution of the main program to thereby execute the timer interrupt program.

Figure 8A:
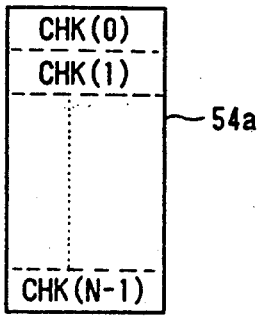
FIGS. 8A to 8C are drawings indicative of data formats of a working memory shown in FIG. 1.
Figure 8B:
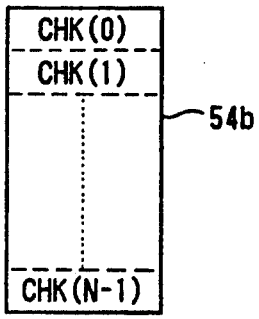
Figure 8C:
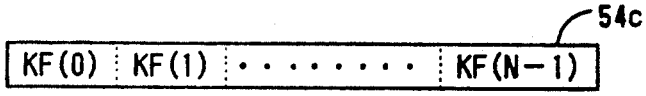

The working memory 54 is constructed by a random-access memory (RAM), which contains a channel key data storing area 54*a*, a channel time data storing area 54*b*, a channel key flag storing area 54*c* and other storing areas. The channel key data storing area 54*a* consists of N registers corresponding to N channels in the musical tone signal generating circuit 40 as shown in FIG. 8A. Each register stores the key code KC indicative of the key assigned thereto as channel key data such as CHK(0)-CHK(N-1). As shown in FIG. 8B, the channel time data storing area 54*b* also consists of N registers corresponding to N channels, wherein each register stores time data indicative of the key-operation time of the key assigned thereto as channel time data such as CHT(0)-CHT(N-1). As shown in FIG. 8C, the channel key flag storing area 54*c* consists of N registers corresponding to N channels, wherein each register stores a key flag of the key assigned thereto as channel key flags KF(0)-KF(N-1). Herein, the key flag at "1" level indicates that the assigned key is depressed, while the key flag at "0" level indicates that the assigned key is released. The other storing areas store several kinds of variables such as an event key code EVKC indicative of the operated key, channel number data ACHN indicative of the number of channel to which the key is assigned, tone color data TC indicative of any one of M tone colors to be set in advance, state data indicative of preceding states of the keys, switches and controls o the keyboard 10 and operation panel 20 in order to detect the operating states of the keys, switches and controls of the keyboard 10 and operation panel 20.

Figure 9:
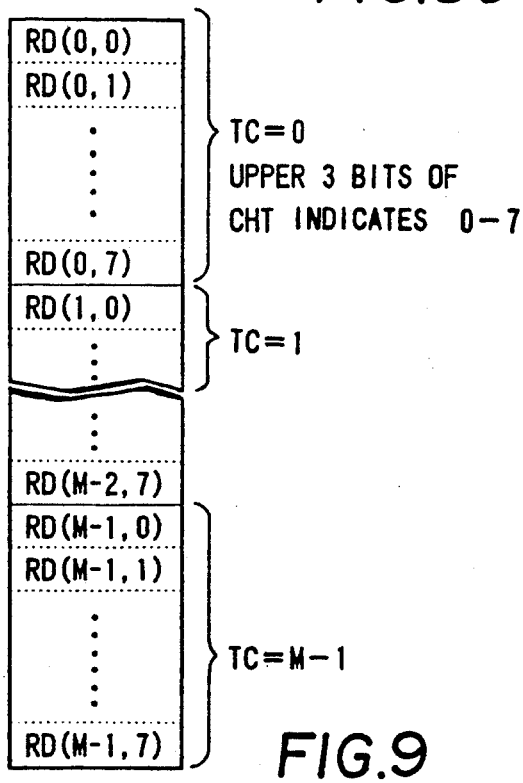
FIG. 9 is a drawing indicative of a data format of a release rate data table shown in FIG. 1.
Figure 10:
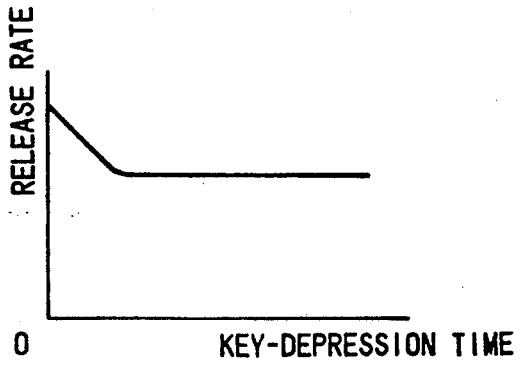
FIG. 10 is a graph showing an example of release rate characteristic.

The release rate data table 55 is constructed by ROM, wherein it stores eight different release rate data RD(TC,0-7) in response to the key-depression time by each of M tone colors (i.e., TC=0 to TC=M-1) as shown in FIG. 9. The release rate data RD is used to vary the release rate of the musical tone signal after the key-release event. For example, as shown in FIG. 10, the value of the release rate becomes lower as the key-depression time becomes longer.

OPERATION OF AN EMBODIMENT

Next, description will be given with respect to the operation of an embodiment by referring to FIGS. 2–7.

Figure 2:
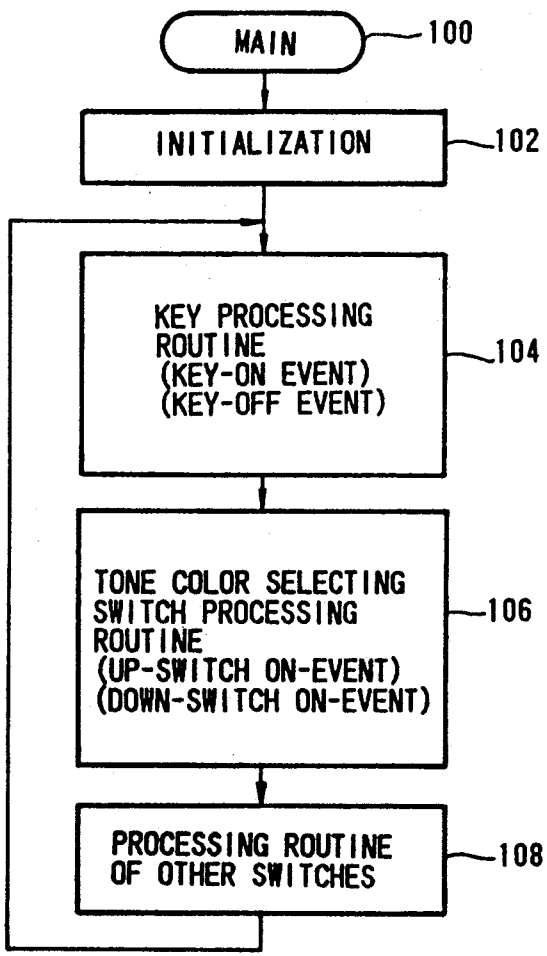

When the power switch (not shown) is on, the CPU 53 starts to execute the main program in step 100 shown in FIG. 2. In next step 102, initialization is carried out. Then, the CPU 53 repeatedly executes circulating processes consisting of a key processing routine of step 104, a tone color selecting switch processing routine of step 106 and a processing routine of other switches of step 108 until the power switch is off.

During execution of the above-mentioned circulating processes, when a new key is depressed in the keyboard 10, it is judged in step 104 that the new key-depression event is occurred, then the CPU 53 reads out and executes a key-on event program. Execution of this key-on event program (whose details is as shown in the flowchart shown in FIG. 4) is started in step 300. In step 302, the key code KC indicative of the newly depressed key is set as an event key code EVKC. In step 304, tone-generation channel assigning process is executed with respect to the newly depressed key. During execution of the tone-generation channel assigning process, unused channel (hereinafter, referred to as space channel) is selected from N musical tone signal forming channels in the musical tone signal generating circuit 40. The value ("0" to "N-1") indicating the space channel is set as assigned channel number data ACHN. Then, channel key data CHK(ACHN) designated by this data ACHN is set to the event key code EVKC.

After executing the above-mentioned tone-generation channel assigning process in step 304, the processing proceeds to step 306 wherein a channel key flag KF(ACHN) designated by the assigned channel number data ACHN is set at "1". In step 308, channel time data CHT(ACHN) designated by the data ACHN is initialized to "0". In step 310, the event key code EVKC, key-on signal KON and tone color data TC are sent to No.ACHN channel in the musical tone signal generating circuit 40, wherein No.ACHN channel is designated by the assigned channel number data ACHN. In last step 312, execution of the key-on event program is completed. Thus, No.ACHN channel starts to generate the musical tone signal having the pitch indicated by the event key code EVKC, i.e., the pitch corresponding to the newly depressed key in the keyboard 10. In this case, tone color and tone volume envelope of the musical tone signal to be generated are set in response to the tone color data TC. Such musical tone signal is supplied to the speaker 42 via the amplifier 41. Therefore, the speaker 42 sounds the musical ton corresponding to the musical tone signal supplied thereto.

Figure 3:
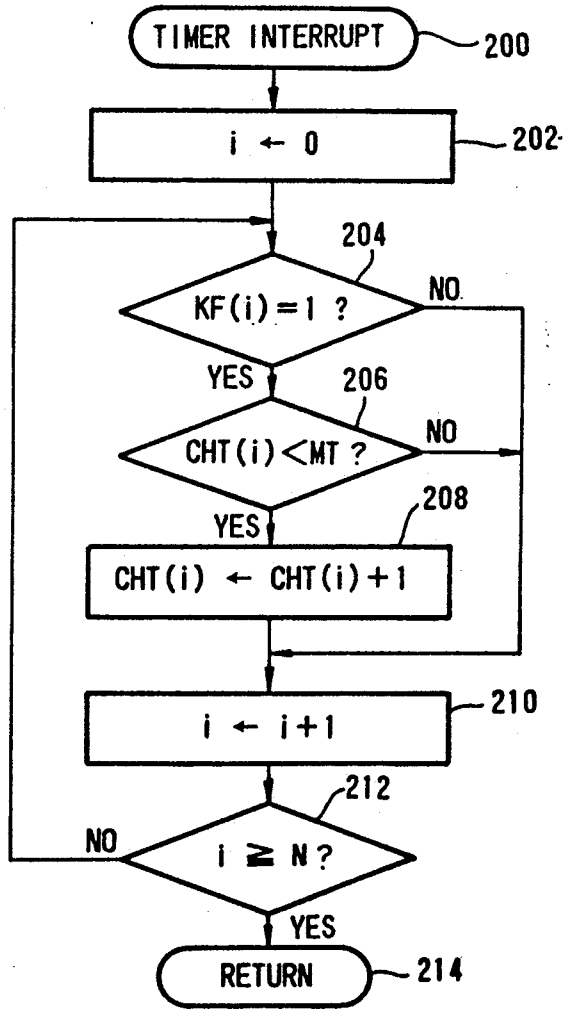
FIGS. 2 to 7 are flowcharts corresponding to several programs to be executed by a micro computer shown in FIG. 1.

During generation of such musical tone, when the timer circuit 52 outputs the timer interrupt signal TINT to the CPU 53, the CPU 53 interrupts execution of the main program to thereby execute the timer interrupt program as shown in FIG. 3. Execution of this timer interrupt program is started in step 200 shown in FIG. 3. In next step 202, a variable i is initialized to "0". Then, under processes of steps 210, 212, the variable i is incremented from "0" to "N-1". While incrementing the variable i, channel time data CHT(i) concerning No.i channel whose channel key flag KF(i) is at "1" is incremented by "1" under processes of steps 204, 208. Herein, the maximum value of this channel time data CHT(i) is limited to the value lower than the predetermined value MT under a process of step 206. During execution of these processes, when the variable i reaches "N", in other words, when the channel time data CHT is renewed with respect to all channels, the judgement of step 212 turns to "YES". Thus, execution of the timer interrupt program is completed in step 214. Thereafter, when the predetermined time is passed after completing the first execution of the timer interrupt program so that the timer interrupt program is executed again, the channel time data CHT(i) concerning No.i channel whose channel key flag KF(i) is at "1" is further incremented by "1" as described before. As a result, the channel time data CHT(i) will indicate the passing time (indicated by "0" to "MT") of depressing the key passed after the key-depression moment.

Figure 5:
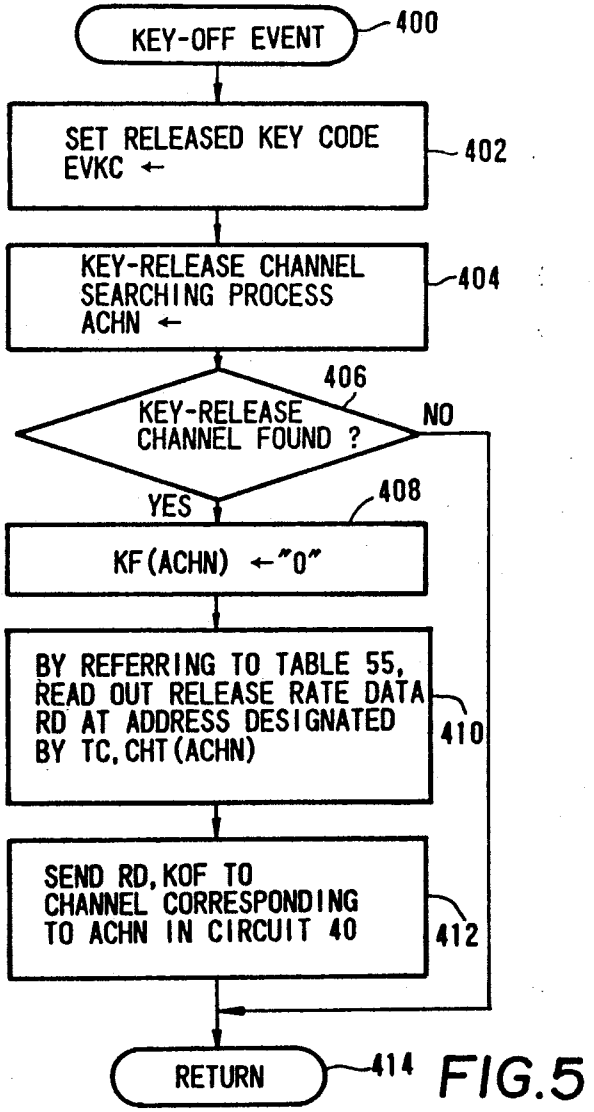
Figure 4:
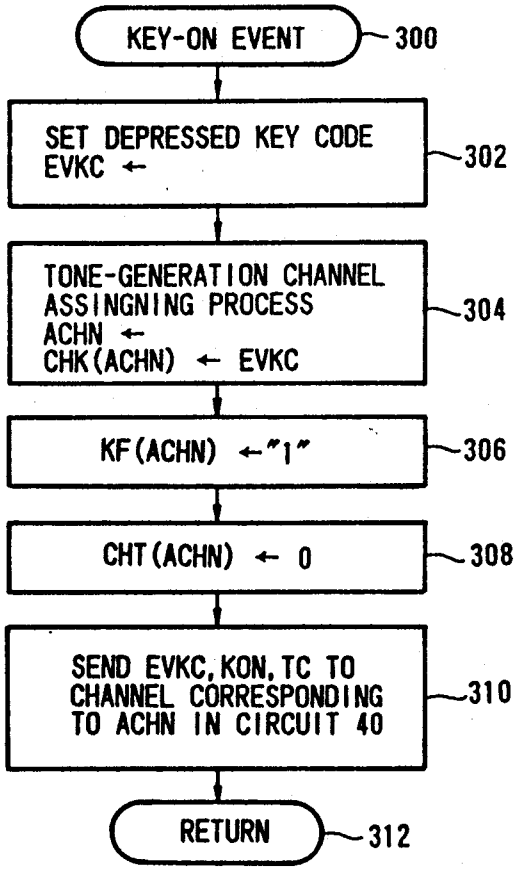

On the other hand, when the depressed key is released, the key-release event is detected in step 104 of the main program shown in FIG. 2, so that the key-off event program is read out and then executed. The details of this key-off event program is shown by the flowchart of FIG. 5. Execution of this key-off event program is started in step 400. In next step 402, the key code KC indicative of the released key is set as the event key code EVKC. Then, a key-release channel searching process is executed with respect to the released key in step 404. In this key-release channel searching process, the CPU 53 searches out the key-release channel in which the channel key flag KF(i) is at "1" indicating that the key is still depressed. In addition, the channel key data CHK(i) identical to the event key code EVKC is to be stored. Then, the variable i indicating the searched channel is set as the assigned channel number data ACHN. After executing the above-mentioned key-release channel searching process the processing proceeds to step 406 wherein it is judged whether or not the key-release channel is found. If not, the judgement of step 406 turns to "NO" so that the processing directly branches to step 414 wherein execution of the key-off event program is terminated. On the other hand, if the key-release channel is found, the judgement of step 406 turns to "YES" so that its succeeding processes of steps 408–412 are to be executed. Thereafter, execution of the key-off event program is completed in step 414.

In step 408, the channel key flag KF(ACHN) designated by the assigned channel number data ACHN is initialized to "0". In step 410, the CPU 53 refers to the release rate data table 55 to thereby read out the release rate data RD designated by the tone color data TC and the upper three bits (i.e., leftmost three bits) of channel time data CHT(ACHN). In step 412, the read release rate data RD and key-off signal KOF are sent to No.ACHN channel of the musical tone signal generating circuit 40. Thus, No.ACHN channel starts to release the musical tone signal which is now generating therein. Then, an attenuation rate applied to the tone volume envelope is controlled with respect to the released musical tone signal in response to the release rate data RD, by which the musical tone signal will fade away. As a result, the musical tone sounded from the speaker 42 gradually fades away.

Figure 11:
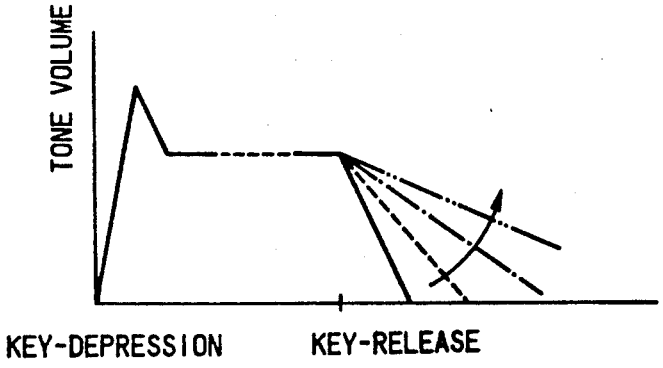
FIG. 11 shows a waveform indicative of the tone volume envelope of the musical tone signal.

As described before, the release rate data RD is set by the characteristic as shown in FIG. 10 such that as the key-depression period becomes longer (i.e., channel time data CHT becomes larger), the release rate data RD becomes smaller. Thus, as the key-depression period becomes longer, the attenuation time of the tone volume envelope concerning the released musical tone becomes longer as shown by solid line, dotted line, dashed line and two-dot chain line in FIG. 11. As a result, in the musical tones performed in short key-depression periods such as staccato tones, termination in generating the musical tone becomes clear and generation of next musical tone corresponding to the next key-depression event also becomes clear. Thus, the performed music becomes clear. In the musical tones performed in long key-depression periods such as legats bowing notes, the musical tones are sounded continuously, by which the performance expression can be smoothed.

Figure 6:
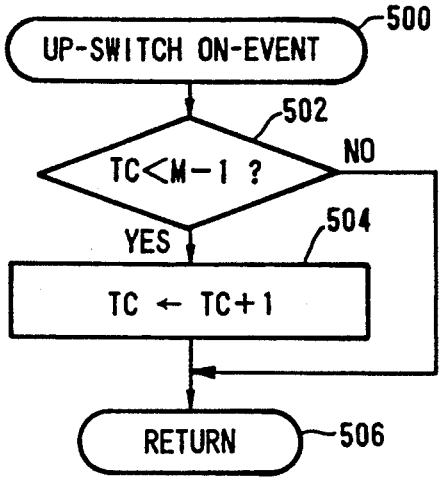
Figure 7:
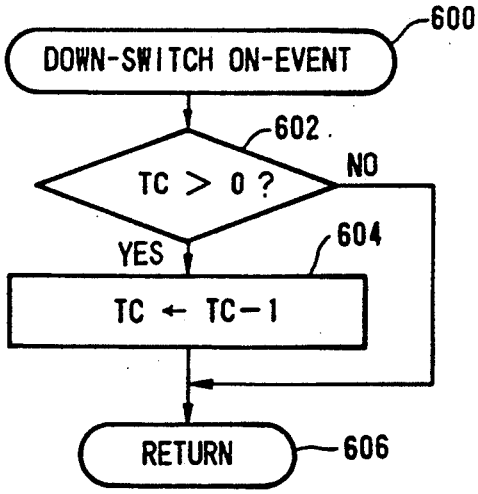

Meanwhile, when the UP switch 21 or DOWN switch 22 is operated in order to vary the tone color, step 106 of the main program shown in FIG. 2 judges that the on-event is occurred on the UP or DOWN switch, so that the UP switch on-event or DOWN switch on-event program is read out and then executed. As shown in FIG. 6, the UP switch on-event program consists of steps 500–506. Under a judging process of step 502 (TC<M-1) and an incrementing process of step 504 (TC=TC+1), the tone color data TC is incremented by "1" every time the UP switch 21 is operated. On the other hand, the DOWN switch on-event program consists of steps 600–606 as shown in FIG. 7. Under a judging process of step 602 (TC>0) and a decrementing process of step 604 (TC=TC-1), the tone color data TC is decremented by "1" every time the DOWN switch 22 is operated. As a result, in response to the variation of tone color data TC which is made by operating the UP switch 21 or DOWN switch 22, the tone color data TC is sent to the musical tone signal generating circuit 40 in step 310 shown in FIG. 4 so that the musical parameters such as the tone color, tone volume envelope of the musical tone signal to be generated are to be controlled. In addition, the release rate data RD is read out and then sent to the musical tone signal generating circuit 40 under processes of steps 410, 412, by which the attenuation envelope characteristic of the musical tone signal which is generated after the key-release event can be controlled in response to the tone color.

Further, when the other switches 23 are operated in order to vary the tone volume and change-over the musical effects, the total tone volume of the musical tone signal and the effect applied to the musical tone signal are respectively controlled under the process of step 108 in the main program shown in FIG. 2.

MODIFICATIONS

The present invention is not limited to the embodiment described heretofore. Therefore, it is possible to incorporate the following modifications within the scope of the present invention.

Figure 12:
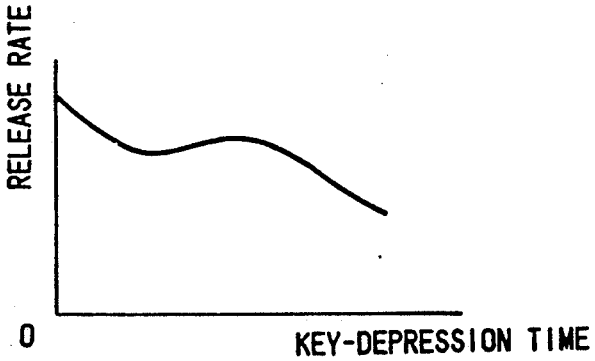
FIG. 12 is a graph indicative of another example of release rate characteristic.

(1) In the present embodiment, the release rate variation characteristic corresponding to the key-depression time is controlled as shown in FIG. 10, wherein it is linearly decreased when the key-depression time is short, but it is set at the constant level when the key-depression time becomes long. Instead, it is possible to control this release rate variation characteristic in response to the tone color as shown in FIG. 12, wherein the release rate variation characteristic is decreased along the waveform shown in FIG. 12 in response to the increase of the key-depression time.

(2) In the present embodiment, the attenuation rate of the tone volume envelope in the musical tone signal generated after the key-release event is controlled in response to the key-depression time. Instead, it is possible to control the pitch, tone color, effect etc. of the musical tone signal generated after the key-release event in response to the key-depression time. In addition, control of the pitch, tone color, effect etc. can be additionally made with the foregoing control of the tone volume envelope. In this case, the table for storing the control data of the pitch, tone color, effect which are varied in response to the key-depression time can be provided instead of or in addition to the release rate data table 55. Then, under the processes of steps 410, 412 shown in FIG. 5, several kinds of control data to be varied in response to the key-depression time are sent to the musical tone signal generating circuit 40. Thus, it is possible to obtain the brand-new performance effect which cannot be accomplished by the conventional apparatus, whereby the performance expression can be further improved.

(3) In the present embodiment, the musical parameters of the musical tone signal which is continuously generated after the key-release event are controlled in response to the key-depression time of the released key. However, in response to this key-depression time, the musical parameters of the new musical tone signal which is newly generated at the next key-depression event can be controlled. For example, the attack rate, attack level etc. can be selected as the above-mentioned musical parameters to be controlled. In this case, under the process of step 310 (shown in FIG. 4) which is executed at the new key-depression event, the musical tone signal generating circuit 40 is supplied with the control data for varying the musical parameters which are set in response to the key-depression time of the precedingly released key.

(4) The present embodiment is an example of the musical tone generating apparatus which adopts the keyboard as the performance information generating means. However, this invention can be applied to the electronic wind instrument which provides a breath sensor for detecting the blowing pressure, applied to its operable member (i.e., key) as the performance information generating means. In addition, it is not necessary to generate the performance information based on the detecting result of the human operable means such as the keyboard. For example, it is possible to apply this invention to the field of the automatic performance apparatus which prestores a series of performance information and then automatically supplies the stored performance information to the musical tone signal generating means by the predetermined tempo. In short, the present invention can be applied to any one of the apparatuses which supplies the performance information to the musical tone signal generating means, wherein this performance information should include the information indicative of the start timings of generating and releasing the musical tone signal.

(5) Further, the present embodiment controls the musical parameters based on single factor, i.e., the key-depression time. However, the present invention can be modified such that the musical parameters are controlled based on the combination of the key-depression time and other information indicative of the initial-touch, release-touch, after-touch and the like.

As described heretofore, this invention may be practiced or embodied in still other ways without departing from the spirit or essential character thereof. Therefore, the preferred embodiment described herein is illustrative and not restrictive, the scope of the invention being indicated by the appended claims and all variations which come within the meaning of the claims ar intended to be embraced therein.

What is claimed is:

1. A musical tone generating apparatus comprising:

(a) performance information generating means for generating performance information designating a first start timing starting to generate a musical signal in response to a first operation by a user of the musical tone generating apparatus and a second timing starting to release said musical tone signal in response to a second operation by the user of the musical tone generating apparatus;

(b) musical tone signal generating means for generating said musical tone signal in response to said performance information;

(c) measuring means for measuring the time period beginning at said first start timing and ending at said second start timing based on said performance information; and (d) control means for controlling one or more musical parameters of said musical tone signal based on said time period measured by said measuring means, whereby a musical tone signal having said one or more musical parameters is controlled by said measured time period.

2. A musical tone generating apparatus according to claim 1 wherein said musical parameters controlled by said control means include at least one of pitch, tone color, tone volume and musical effects to be applied to said musical tone signal.

3. A musical tone generating apparatus according to claim 1 wherein said performance information generating means is constructed by a keyboard providing plural keys so that said performance information is generated by performing said keyboard, whereby said period measured by said measuring means corresponds to a key-depression period of each key.

4. A musical tone generating apparatus according to claim 3 wherein said first start timing represents a key-on timing and said second start timing represents a key-off timing.

5. A musical tone generating apparatus according to claim 1 wherein said musical parameter represents an envelope release speed.

6. A musical tone generating apparatus according to claim 5 wherein said envelope release speed is controlled to be faster as said period measured by said measuring means becomes shorter.

7. A musical tone generating apparatus according to claim 1 wherein said musical parameter represents an envelope release time.

8. A musical tone generating apparatus according to claim 7 wherein said envelope release time is controlled to be shorter as said period measured by said measuring means becomes shorter.

9. A musical tone generating apparatus for producing a musical tone comprising:

(a) performance information generating means for generating first performance information for indicating the starting of said musical tone in response to a first operation by a user of said electronic musical instrument and second performance information representing the note length of said musical tone in response to a second operation by the user of said electronic musical instrument;

(b) musical tone signal generating means for generating musical tone signals in response to said first performance information;

(c) control means for controlling a musical parameter of one of said musical tone signals in response to said second performance information, whereby one of said musical tone signals is generated in accordance with said musical parameter controlled by said control means.

10. A musical tone generating apparatus according to claim 9 wherein said musical parameters controlled by said control means include at least one of pitch, tone color, tone volume and musical effects to be applied to said second musical tone signal.

11. A musical tone generating apparatus according to claim 9 wherein said musical parameter of said musical tone signal represents envelope release speed.

12. A musical tone generating apparatus according to claim 11 wherein said envelope release speed is controlled to be faster as said period measured by said measuring means becomes shorter.

13. A musical tone generating apparatus according to claim 9 wherein said musical parameter of said musical tone signal represents an envelope release time.

14. A musical tone generating apparatus according to claim 13 wherein said envelope release time is controlled to be shorter as said period measured by said measuring means becomes shorter.

15. A musical tone generating apparatus according to claim 9 wherein said musical parameter of said musical tone signal represents an envelope attack speed.

16. A musical tone generating apparatus according to claim 15 wherein said envelope attack speed is controlled to be faster as said period measured by said measuring means becomes shorter.

17. A musical tone generating apparatus according to claim 9 wherein said musical parameter of said musical tone signal represents an envelope attack time.

18. A musical tone generating apparatus according to claim 17 wherein said envelope attack time is controlled to be shorter as said period measured by said measuring means becomes shorter.

19. A musical tone generating apparatus according to claim 9 wherein the musical tone signal generated based on said first performance information is identical with the musical tone signal whose parameter is controlled based on said second performance information.

20. A musical tone generating apparatus according to claim 9 wherein said performance information generating means comprises designation means for designating a start timing of a note and a stop timing of a note, and measuring means for measuring a period between said start timing and stop timing of the note, whereby said first performance information is generated based on said start timing designated by said designation means, and said second performance information representing length of said note is generated based on said period measured by said measuring means.

21. A musical tone generating apparatus according to claim 20 wherein said designating means comprises a keyboard having plural keys, wherein said performance information is generated by performing said keyboard, and wherein said period measured by said measuring means corresponds to a key-depression period of each key.

22. A musical tone generating apparatus according to claim 9 wherein the musical tone signal generated based on said first performance information is different from the musical tone signal whose parameter is controlled based on said second performance information.

23. A musical tone generating apparatus according to claim 1 wherein said performance information generating means further generates touch information representing the strength or velocity of a performance manipulation, and wherein said controlling means controls said one or more parameters based on combination of said period and said touch information.

24. A musical tone generating apparatus according to claim 9 wherein said performance information generating means further generates touch information representing the strength or velocity of a performance manipulation, and wherein said controlling means controls said one or more parameters based on a combination of said period and said touch information.

25. A musical tone generating apparatus comprising:

(a) a keyboard having a plurality of keys for generating a key-on signal and a key-off signal;

(b) musical tone signal generating means for generating a musical tone based on said key-on signal and key-off signal;

(c) measuring means for measuring the time period beginning with a key-on timing at which said key-on signal is generated and ending at a key-off timing at which said key-off signal is generated;

(d) envelope controlling means for controlling the amplitude of said musical tone based on envelope parameters including a release parameter for controlling an amplitude variation of said musical tone after said key-off timing; and (e) parameter controlling means for controlling said release parameter based on said time period measured by said measuring means.

26. A musical tone generating apparatus according to claim 23 wherein said keyboard further generates touch information representing the velocity of depression of said key, and wherein said parameter controlling means controls said release parameter based on a combination of said period and said touch information.

* * * * *